US008234966B2

(12) United States Patent
Shapochnik

(10) Patent No.: US 8,234,966 B2
(45) Date of Patent: Aug. 7, 2012

(54) BALLISTIC ARMOR

(75) Inventor: Mark Shapochnik, Kiryat Ata (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 205 days.

(21) Appl. No.: 12/730,442

(22) Filed: Mar. 24, 2010

(65) Prior Publication Data

US 2010/0251882 A1 Oct. 7, 2010

(30) Foreign Application Priority Data

Apr. 7, 2009 (IL) ..... 198099

(51) Int. Cl.
*F41H 5/04* (2006.01)

(52) U.S. Cl. ..... 89/36.02; 89/908; 89/917; 89/937

(58) Field of Classification Search ..... 89/36.02, 89/906, 907, 908, 909, 917, 937; 244/121
See application file for complete search history.

(56) References Cited

U.S. PATENT DOCUMENTS

| | | | | |
|---|---|---|---|---|
| 3,431,818 | A * | 3/1969 | King | 89/36.02 |
| 6,112,635 | A * | 9/2000 | Cohen | 89/36.02 |
| 6,408,734 | B1 | 6/2002 | Cohen | |
| 6,920,817 | B2 | 7/2005 | Ravid et al. | |
| 7,833,627 | B1 * | 11/2010 | Ferrando | 428/416 |
| 2007/0034074 | A1 | 2/2007 | Ravid et al. | |

* cited by examiner

*Primary Examiner* — Stephen M Johnson
(74) *Attorney, Agent, or Firm* — Workman Nydegger

(57) ABSTRACT

An armor plate is provided for use in the ballistic protection of a structure against projectiles incoming from an expected threat direction. The armor plate comprises a layer of pellets made of ballistic material; a gap having a contour at least partially defined by circumferential surfaces of those of the pellets that are exposed to the gap, and occupying an area corresponding to a plurality of the pellets; and an insert inserted within the gap and having an outer surface at least a part of which has an outer shape mimicking the contour of the gap. There is also provided a method for producing the armor plate and an insert for use therein.

14 Claims, 8 Drawing Sheets

BALLISTIC ARMOR

FIELD OF THE INVENTION

The present invention is directed to composite ballistic armor adapted to provide protection of a structure such as a vehicle, against a ballistic threat, in particular against armor-piercing projectiles. The invention particularly refers to such armor comprising a layer of pellets made of high density material and a backing layer.

BACKGROUND OF THE INVENTION

Ballistic armor of the kind to which the present invention refers may be stand-alone armor or add-on armor, adapted for mounting to a wall of a structure to be protected, and it normally comprises a first layer of ceramic pellets facing the threat direction, adapted to dissipate the energy of an impacting projectile and to deform or shatter it, and a second, backing layer attached to the front layer and adapted, alone or together with the wall of a structure to be protected, to absorb the energy of the projectile including its fragments and prevent their penetration through the wall into the protected structure. Such armor normally has high multi-hit capability, since damage to the armor is localized to one pellet or a small number of pellets at the area of impact. The armor may further comprise additional layers, such as for example a front layer disposed in front of the first layer with respect to the threat direction.

US 2007/0034074 discloses one example of such armor and a method of its manufacturing, which may also be used to produce armor plates according to the present invention.

Armor plate of the kind described above may be mounted to a structure to be protected in a number of ways. In case, they are mounted by fixation elements such as, for example fixation screws, the armor plate may be pre-formed with bores for passing such fixation elements therethough and allowing their engagement with corresponding fixation elements in the structure to be protected.

Armor plates of the kind described may also have apertures different from the bores mentioned above, e.g. corresponding in shape and dimensions to portions of the protected structure's wall, which do not need to be protected with the described armor.

To provide the above bores or apertures, it is known to produce armor plates with inserts mounted in the layer of ceramic pellets, replacing a group of adjacent pellets therein, and having formed therein such bores or apertures. The inserts have a circumference of a standard, regular outer shape, normally rectangular or square, and gaps created between the circumference of each such insert and pellets of the armor plate surrounding it, normally filled with fragments of pellets or other ballistic material to avoid undesired discontinuities/voids in the layer of pellets.

SUMMARY OF THE INVENTION

In accordance with one aspect of the present invention, there is provided an armor plate for use in the ballistic protection of a structure against projectiles incoming from an expected threat direction. The plate has a front face facing said threat direction and comprises:

- a layer of pellets made of ballistic material, each having a circumferential surface transverse to said front face;
- a gap having a contour at least partially defined by circumferential surfaces of those of said pellets that are exposed to said gap and occupying an area corresponding to a plurality of said pellets; and
- an insert inserted within said gap and having an outer surface at least a part of which has an outer shape mimicking the contour of said gap.

In the present application, the term 'expected thread direction' refers to a direction generally perpendicular to the front face of the plate.

The term "ballistic material" means a hard material capable of resistance to penetration by a projectile.

The insert may be at least partially made of a ballistic material different from, or similar to, that of the pellets, both for its use in the ballistic protection of the structure in its area corresponding to the insert, and for its use other than such protection. Alternatively, it may be at least partially made of a material not having ballistic properties, e.g. having hardness lower than that of the material of the pellets.

The insert may comprise an insert frame having said outer surface and having an inner surface of an inner shape different from said outer shape.

The insert frame may be adapted to receive therein at least one core element whose outer surface corresponds in shape and dimension to the inner surface of said frame, and whose interior may be adapted for use other than, or additional to, provision of ballistic protection to said structure in its area corresponding to or associated with said insert or said core.

Thus, for example, the interior of the core may be formed with a fixation bore adapted to let a fixation screw pass therethrough for use in attaching said plate to said structure. The core element may have a central axis and may be received within said frame so as to be rotatable about said central axis, and said fixation bore may have an axis spaced from said central axis of the core so that, upon the rotation of said core, said fixation bore takes different positions relative to the inner surface of said frame.

The structure to be protected may have at least one portion not to be protected by said armor plate but to be surrounded thereby, wherein said inner shape of the frame corresponds to that of said portion.

The contour of the gap may be at least partially defined by an edge of said plate The armor plate may further comprise a binder matrix constituting together with the layer of pellets and the insert a main armor layer, and may further comprise at least one additional layer constituting a front or a back layer of the plate, or the plate may have both the front and the back layers. Said main layer and said at least one additional layer are integrally formed with a binder material forming said matrix and serving to bind the at least one additional layer to the main layer.

The material from which the insert is at least partially made may be a solidifying material capable of being disposed in said gap in a non-solidified state and of being brought into its solidified state within the gap to form at least a part of said insert.

The pellets may have both faces planar or convex or one convex and one planar face, and their circumferential surface may have any appropriate cross-sectional shape. In particular, the pellets may be cylindrical and have circular cross-sectional shape, or they may have a polygonal, for example square or hexagonal cross-sectional shape, such as for example, in an armor plate disclosed in IL 190360.

The armor plate may comprise a plurality of inserts, each inserted within a corresponding gap and having an outer surface at least a part of which has an outer shape mimicking the contour of said gap.

method of manufacturing of an armor plate for use in the ballistic protection of a structure against projectiles incoming from an expected threat direction, said plate having a front face facing said threat direction, a back face and side walls therebetween, the method comprising:

(a) providing a plurality of pellets to constitute a layer of pellets, each having a circumferential surface transverse to said front face and leaving in said layer a gap occupying an area corresponding to a group of adjacent pellets, the gap having a contour at least partially defined by the circumferential surfaces of the pellets surrounding said gap;

(b) providing an insert having an outer shape mimicking the contour of said gap;

(c) applying a binder material to the pellets and the insert; and (d) heating the binder material to simultaneously form a matrix, which constitutes with the pellets and the insert a main armor layer.

The method may further comprise providing front and/or back layer, having a cutout corresponding to said insert. When the matrix formed in the step (d), it may bind the front and/or back layer to said main armor layer, to form the corresponding front and/or back faces of the plate.

The method may further comprise:

a first additional step of arranging the front layer in the form of a cavity, having a generally horizontal bottom and generally vertical side walls, corresponding in shape and dimensions to the front face and side walls of the plate, performed before said step (b);

a second additional step of arranging the pellets and the insert in the cavity so that the insert overlies the corresponding cutout in said front layer, performed after said first additional step and before said step (b);

a third additional step of introducing the binder material in the cavity, performed after said second additional step and before said step (c); and a fourth additional step of applying the back layer to the back of the arranged pellets and insert so that the cutout in the back layer overlies the insert, performed after said third additional step and before said step (d).

The method may further comprise a fifth additional step of mounting within said insert frame at least one core occupying the interior of said frame, performed between said steps (a) and (b).

The method may further comprise the steps of:

a sixth additional step of covering said insert with a cover before performing said second additional step, to prevent the binder material from entering those portions of the insert that are covered by the cover, and a seventh additional step of removing the cover after said sixth additional step.

The cover may be adapted to cover said fixation bore. The cover may further correspond to the portion of the structure not to be protected by said armor plate.

In accordance with another aspect of the present invention, there is provided an insert designed for mounting in an armor plate layer comprising an array of closely packed pellets made of ballistic material, each having a circumferential surface, and a gap within said armor layer having a contour at least partially defined by circumferential surfaces of those of said pellets that are exposed to said gap and occupying an area corresponding to a plurality of said pellets; said insert having an outer surface at least a part of which has an outer shape mimicking the contour of said gap.

The use of insert(s) according to the present invention facilitates the manufacturing process of armor plates of the kind to which the present invention refers, having inserts incorporated therein, without leaving unnecessary voids between the inserts and pellets surrounding them.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1B:
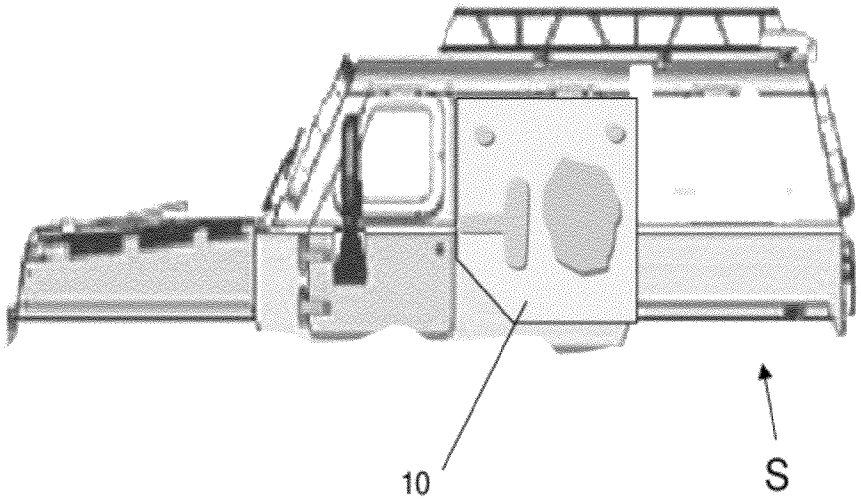
FIG. 1B is a schematic illustration of a vehicle to which the armor plate shown in FIG. 1A is to be mounted.
Figure 1A:
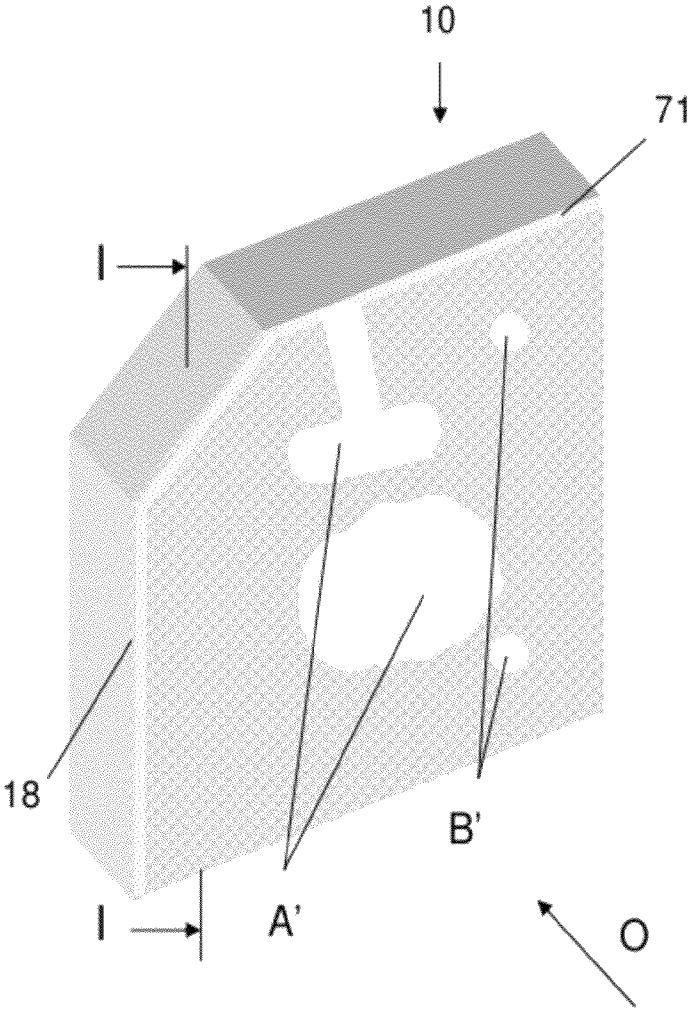
FIG. 1A is a schematic perspective view of one example of a composite armor plate according to the present invention.

FIG. 1A show one example of an armor plate 10 according to the present invention, designed for use in ballistic protection of a basic structure S, e.g. a side wall W of a vehicle, against projectiles coming from an expected threat direction O as shown in FIG. 1B. As further shown in FIG. 1B, the side wall W is provided with fixation bores B adapted to receive therein fixation elements such as fixation screws (not shown), by which the plate 10 is adapted for mounting to the vehicle's side wall W, and areas A which are not to be protected by the armor plate 10. As seen in FIG. 1A, the plate 10 is thus formed with bores B' used to allow the passage of the fixation elements therethrough and apertures A' corresponding in size and shape to the areas A of the vehicle's side wall W, which are not to be protected by the armor plate 10.

Figure 2B:
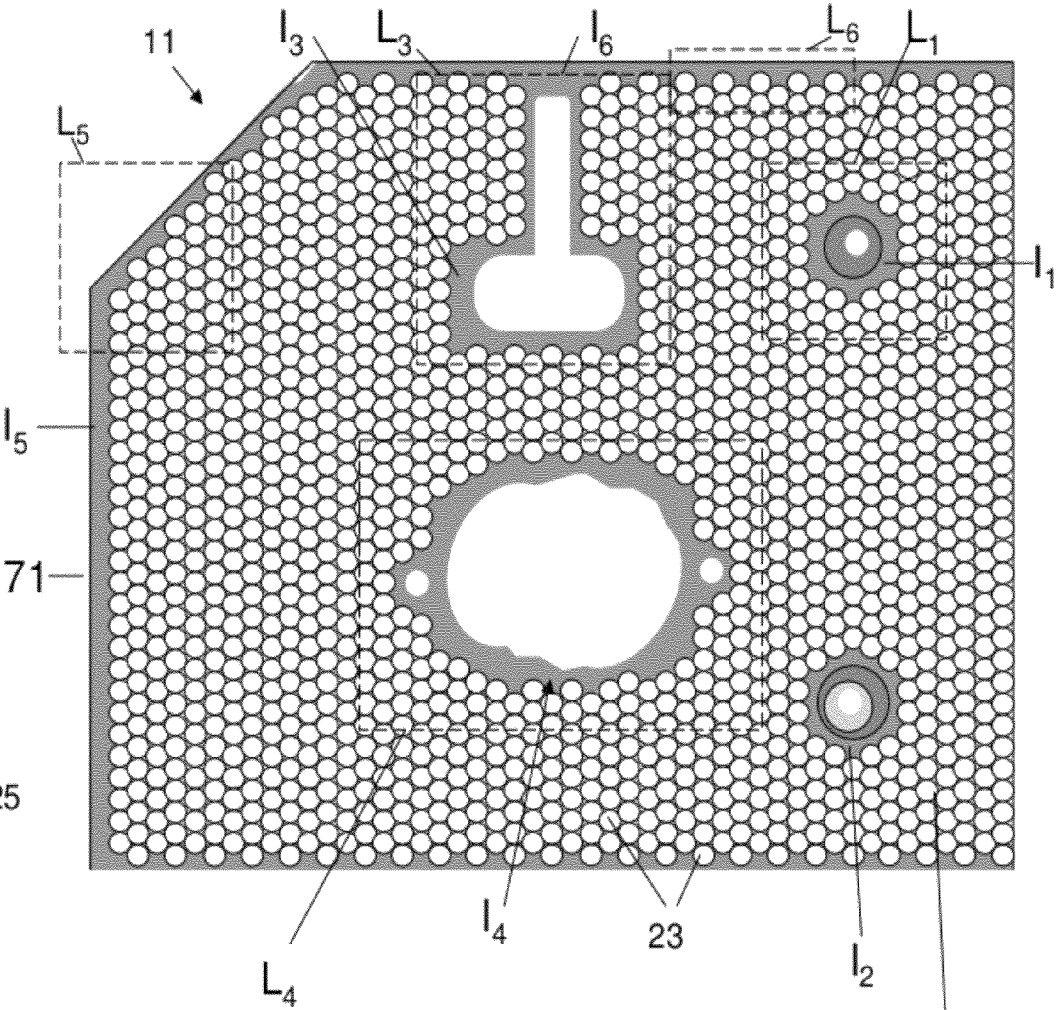
FIG. 2B is a front view of a main armor layer of the plate shown in FIG. 2A.
Figure 2A:
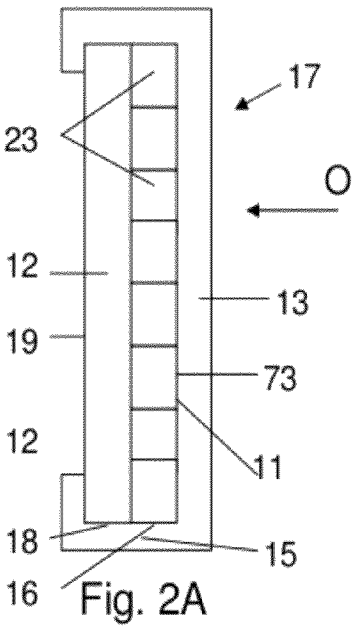
FIG. 2A is a schematic cross-sectional view of the armor plate shown in FIG. 1A, taken along a plane designated by line I-I in FIG. 1A, which is perpendicular to front face of the armor plate.

As shown in FIG. 2A, the plate 10 is in the form of a multi-layer structure comprising the following layers: a main armor layer 11; an additional, front layer 13 having a front face 17, which faces the expected threat direction O (for the purpose of the armor plate's design, the direction O is considered to be perpendicular to the front face 17 of the armor plate; an additional, back layer 12 having a rear face 19 opposite to the front face 17, and side layer portions 15 constituting a part of the front layer 13 and attached to side surfaces 16 of the main armor layer 11 and 18 of the back layer 12. As seen in FIG. 1A, all the layers 11, 12 and 13 of the plate 10 are formed with bores B' and apertures A' corresponding to the bores B and the areas A of the wall W, as explained above.

Figure 2C:
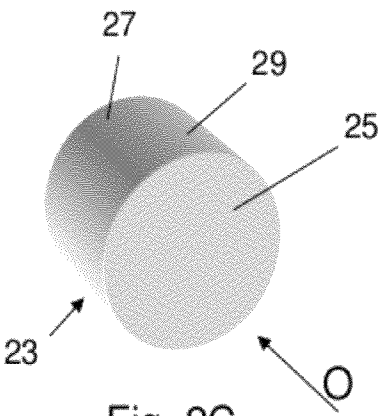
FIG. 2C is a schematic perspective view of a pellet constituting a part of the main armor layer shown in FIG. 2B.

As shown in FIGS. 2A and 2B, the main layer 11 comprises an array of closely packed pellets 23 whose shape is shown in FIG. 2C. Each pellet 23 comprises a front surface 25 facing the expected threat direction O, rear surface 27 facing the back layer 12, and a circumferential surface 29 extending therebetween.

The pellets 23 are made of high density armor material, e.g., ceramic, such as for example alumina, silicon carbide, silicone nitride, boron carbide or the like.

The main layer 11 further comprises a plurality of inserts I, each having an outer shape at least a part of which is such as to suit a corresponding gap or area in the armor plate occupied thereby, and when relevant, an interior designed according to the function it fulfills. Thus, as described in more detail below, inserts $I_1$ and $I_2$ are used to form the bores B' adapted to let a fixation element pass therethrough as mentioned above, and accordingly they have a cylindrical inner shape; inserts $I_3$ and $I_4$ are used to form the apertures A' corresponding in size and shape to the areas A of the vehicle's side wall W, that do not need to be protected, and accordingly they have an inner shape of these apertures; and inserts $I_5$ and $I_6$ are designed to be used as edge inserts serving to ensure that the main armor layer 11 has straight edges 71 corresponding to edges 73 of the plate 10, whilst filling empty spaces between these edges and those pellets, which are closest thereto but still spaced therefrom to a distance not large enough to receive therein entire pellets 23 The inserts $I_1$ to $I_6$ will now be described in more detail below.

Figure 3B:
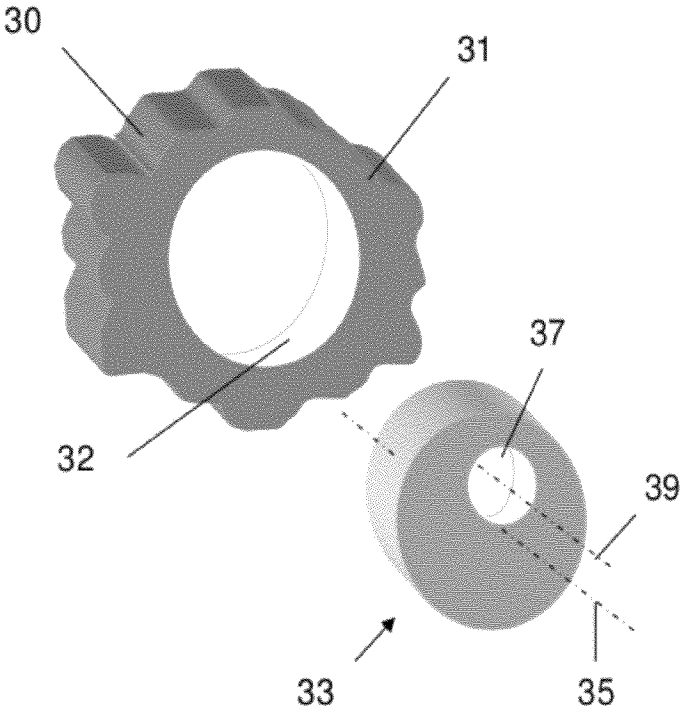
FIG. 3B is a schematic perspective view of an insert shown in FIG. 3A as mounted in the area L1.
Figure 3A:
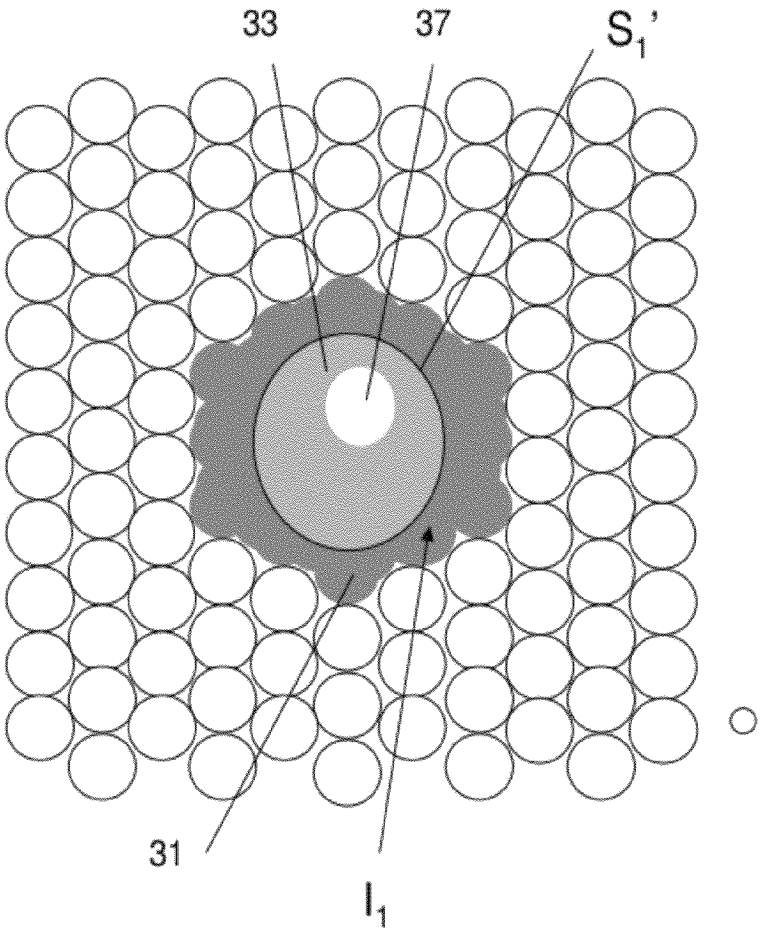
FIG. 3A is an enlarged view of an area $L_1$ of the main armor layer shown in FIG. 2B.

With reference to FIGS. 3A and 3B, the insert $I_1$ comprises a frame 31 having an outer surface 30 of shape $S_1$ and an inner surface 32 of shape $S_1'$. As shown in more detail in FIGS. 4B and 4C, the shape $S_1$ of the surface 30 mimics the contour $C_A$ of a corresponding gap $\mathbf{17}_A$ in the armor plate 10, which is defined by circumferential surfaces 29 (FIG. 2C) of the pellets 23 (shown in bold in FIGS. 4B and 4C) exposed to the gap $\mathbf{17}_A$, and allows thereby a tight fit between the insert $I_1$ and the exposed pellets 23.

The shape $S_1'$ of the inner surface 32 is cylindrical (FIG. 3B) to allow the frame 31 to receive therein a cylindrical core 33 having a fixation bore 37 formed therein, which is adapted to let passing therethrough of a fixation element or screw by means of which the armor plate 10 is mounted to the vehicle's side wall W. The cylindrical core 33 and the fixation bore 37 therein have respective central axes 35 and 39, the latter being radially spaced from the former, i.e. the fixation bore 37 is disposed eccentrically within the cylindrical core 33. The cylindrical core 33 is so received within the frame 31 as to be able to rotate therewithin about its axis 33 relative to the inner surface 32 to bring the fixation bore 37 into a desired position in the plate 10.

Figure 5B:
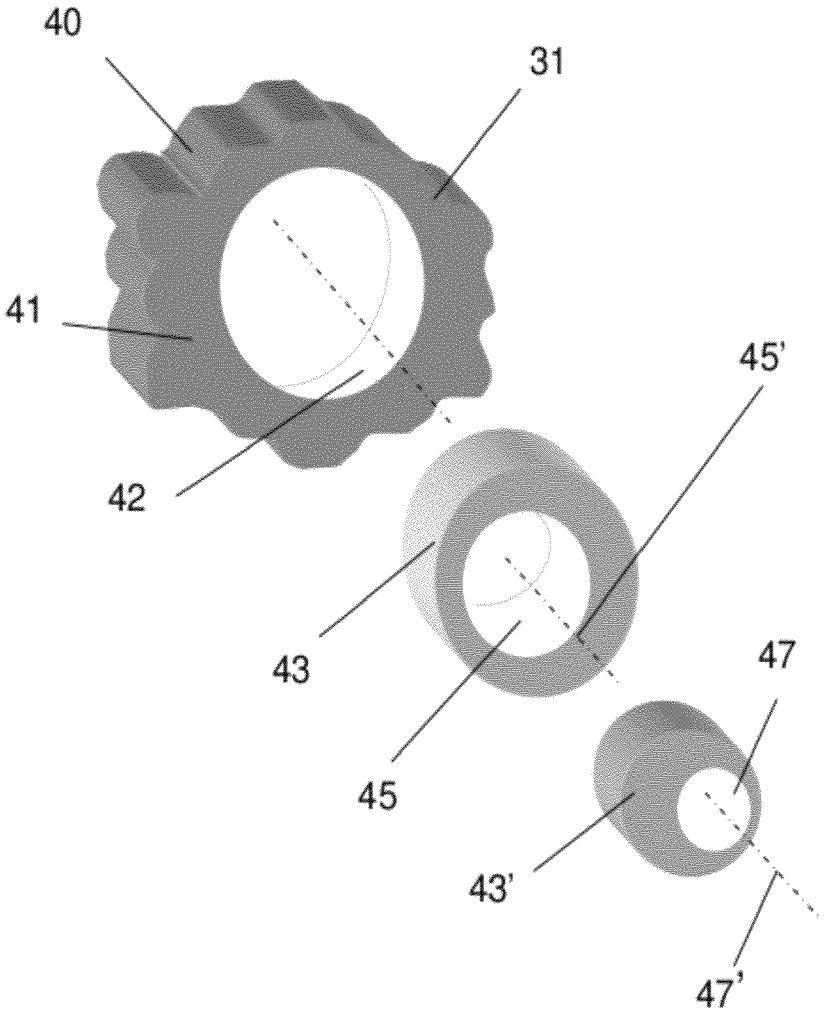
FIG. 5B is a schematic perspective view of an insert shown in FIG. 5A as mounted in the area of the main armor layer.
Figure 5A:
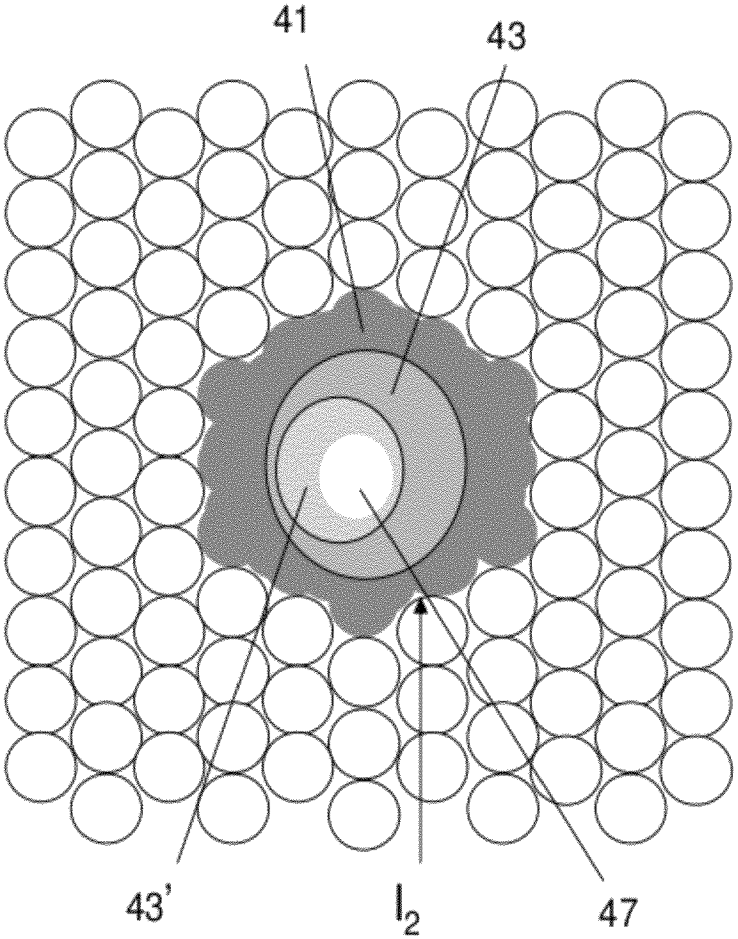
FIG. 5A is an enlarged view of an area $L_2$ of the main armor layer shown in FIG. 2B.

With reference to FIGS. 5A and 5B, the insert $I_2$ is similar to the insert $I_1$ in that it has a frame 41 with an outer surface 40 of a shape $S_2$ and an inner surface 42 of a cylindrical inner shape $S_2'$ for receiving therein a cylindrical core 43 having a central axis 49. The difference between the two inserts is in that the cylindrical core 43 has a cylindrical hole 45 with an axis 45' spaced from the axis 49, which receives therein a further cylindrical core 43' with a cylindrical fixation bore 47 formed therein and adapted to let passing therethrough of a fixation element or screw by means of which the armor plate 10. The second cylindrical core 43' has a central axis 47' coinciding with that of the central axis 49 of the first cylindrical core 43 and the fixation bore 47 has a central axes 45' radially spaced from the central axis 47' of the second cylindrical core. Thus, the second cylindrical core 43' is disposed eccentrically within the first cylindrical core 43, and the fixation bore 47 is disposed eccentrically within the second cylindrical core 43'. The cylindrical cores 43 and 43' is so received within the frame 41 as to be able to rotate with respect to the inner surface 42 and with respect to each other about their central axes to bring the fixation bore 47 into a desired position in the plate 10.

Figure 6B:
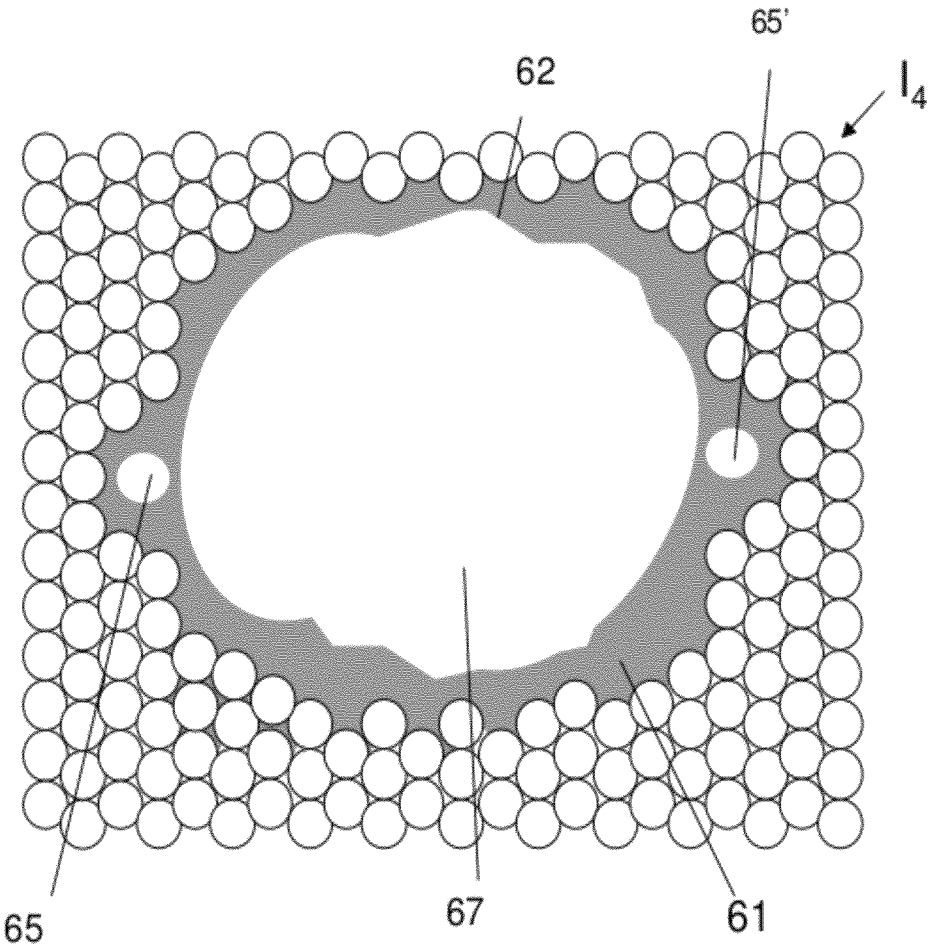
FIGS. 6A to 7B are enlarged views of areas $L_3$ to $L_6$, respectively, of the main armor layer shown in FIG. 2B.
Figure 6A:
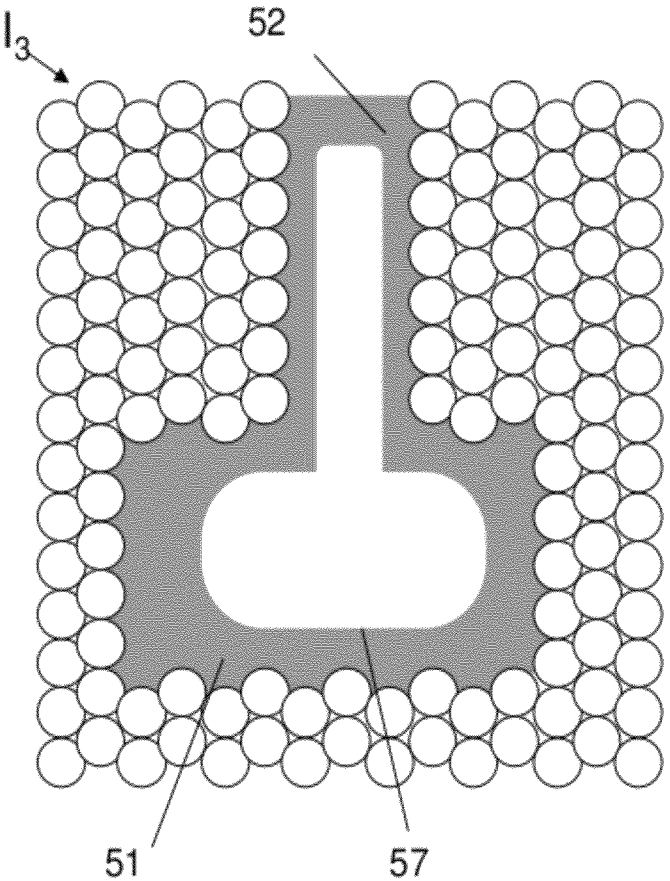

With reference to FIGS. 6A and 6B, the inserts $I_3$ and $I_4$ are constituted by respective frames 51 and 61 of inner shapes 52 and 62 defining apertures 57 and 67, respectively, serving to form the apertures A' of the plate 10 corresponding to the areas A of the wall W.

The frame 61 may further comprise apertures 65 and 65' to meet the requirements of the wall W to be protected.

The inserts $I_2$ to $I_4$ described above all have their outer shape which, similarly to the outer shape $S_1$ of the frame 31, mimics the contour of a corresponding gap in the armor plate 10 (similar to that shown in FIGS. 4A to 4C with respect to the insert $I_1$), which is constituted by circumferential surfaces 29 of the pellets 23 surrounding that corresponding gap, and allows thereby a tight fit between each one of the inserts $I_2$ to $I_4$ and the surrounding pellets 23.

Figure 4B:
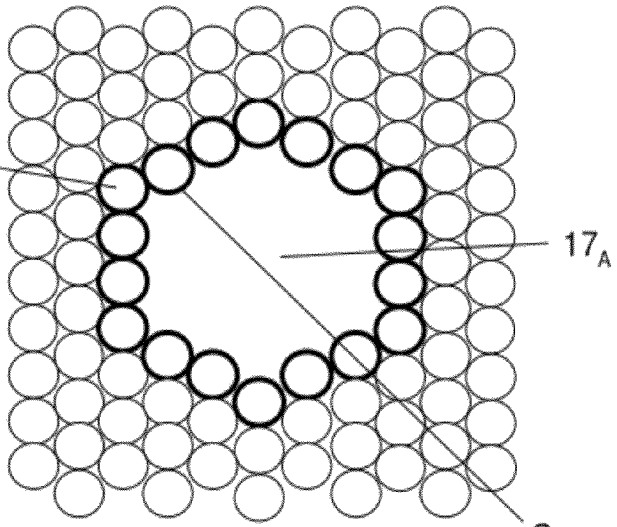
FIGS. 4A to 4C are schematic presentations illustrating the geometry of the area L1 shown in FIG. 3A.
Figure 4A:
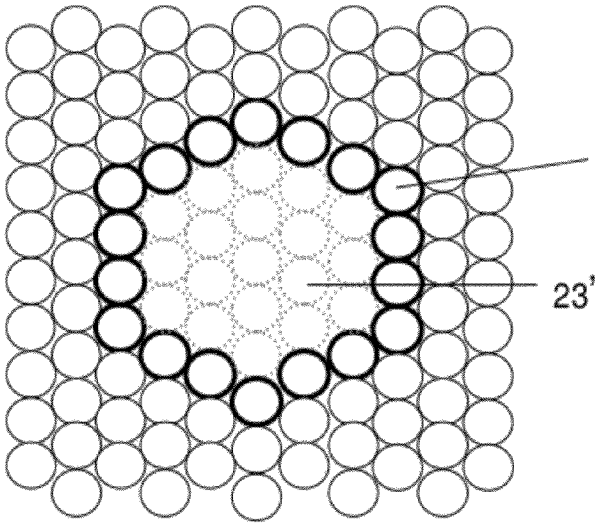
Figure 4C:
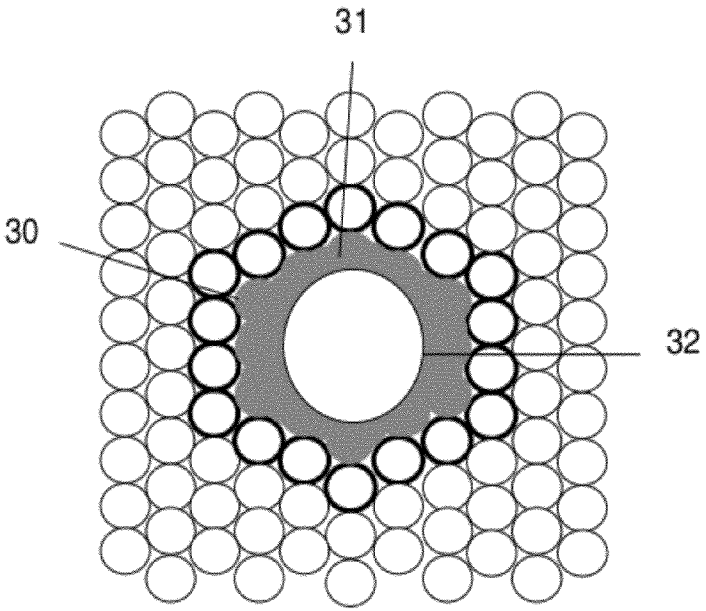
Figure 7B:
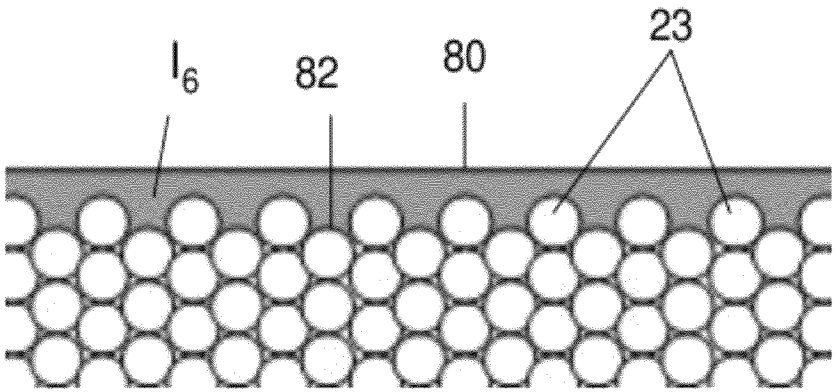
Figure 7A:
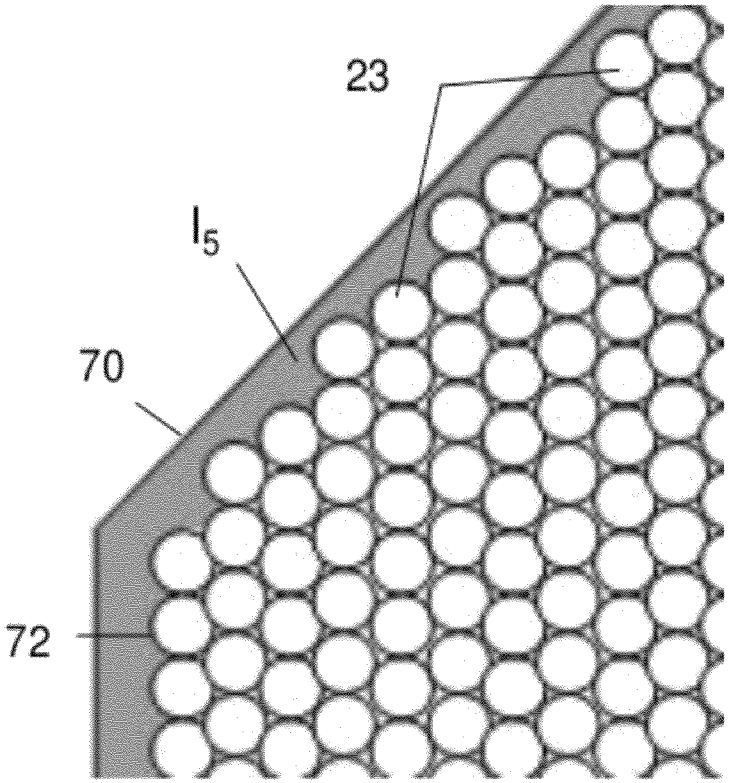

With reference to FIGS. 7A and 7B, the inserts $I_5$ and $I_6$ are edge inserts, situated adjacent to the edges 71 (FIG. 1A) of the plate 10 and having outer surfaces 70 and 80 of shapes $S_5$ and $S_6$, respectively, adapted to complete corresponding the edges 73 of the main armor layer 11 of the armor plate 10, and inner surfaces 72 and 82, of shapes $S_5'$ and $S_6'$, respectively, mimicking the contours of the pellets 23 adjacent to the edges 73 in a manner similar to that shown in FIGS. 4A to 4C with respect to the insert $I_1$. As mentioned above, this kind of inserts may be particularly useful for providing the main armor layer 11 with straight edges 73 whilst filling empty spaces remaining between these edges and pellets 23 closest thereto but spaced therefrom by a distance which is not large enough to receive therein entire pellets 23.

The inserts described above are made of material similar to that of the pellets 13 or different from that of the pellets 23. In particular, the material of the inserts depends on the level of protection needed to those portions of the wall W of the structure B, where the insert is positioned when the armor plate 10 is mounted to the wall W. When inserts are used for fixation, in places where ballistic protection is required, the inserts may be made of a high density armor material or another ballistic material such as for example steel. Alternatively, when placed adjacent to areas of the wall W of the structure B where no ballistic protection is required, the inserts may be made of material having lower hardness than that of the pellets, such as aluminum.

The armor plate 10 may be manufactured by a process disclosed in US 2007/0034074 to the Applicant, the description of which is incorporated herein by reference, with the following differences. Before the introduction of the front and back layers 13 and 12 into a mold, they are formed with cutouts (seen in the front layer in FIG. 1A) corresponding in shape and dimensions to the bores B' and the apertures A' with which the plate 10 is to be formed. During the arrangement of the pellets 23 within a cavity formed by the arrangement of the front layer 13 within the mold, the inserts are placed in their corresponding gaps such as the gap $\mathbf{17}_A$ shown in FIG. 4B, receiving therein the insert $I_1$ as shown in FIG. 4C, replacing a corresponding group of pellets, such as the pellets 23' shown in dashed line in FIG. 4A, that were supposed to be there.

When the inserts are in the form of frames with core elements received therein, such as the inserts $I_1$ and $I_2$, the frames such as frames 31 and 41 are first mounted in the corresponding gaps, and the core elements such as the core elements 33, 43 and 43' are then inserted within the respective frames 31 and 41. When the core elements, in particular those having fixation bores such as bores 37 and 47 formed therein, are designed to rotate within their corresponding frames as described above, this rotation allows the fixation bores 37, 47 to take different positions relative to the frame 31, 47 so as to reach a best fit between the fixation bore 37, 47 and its corresponding fixation bore within the wall W.

Figure 8:
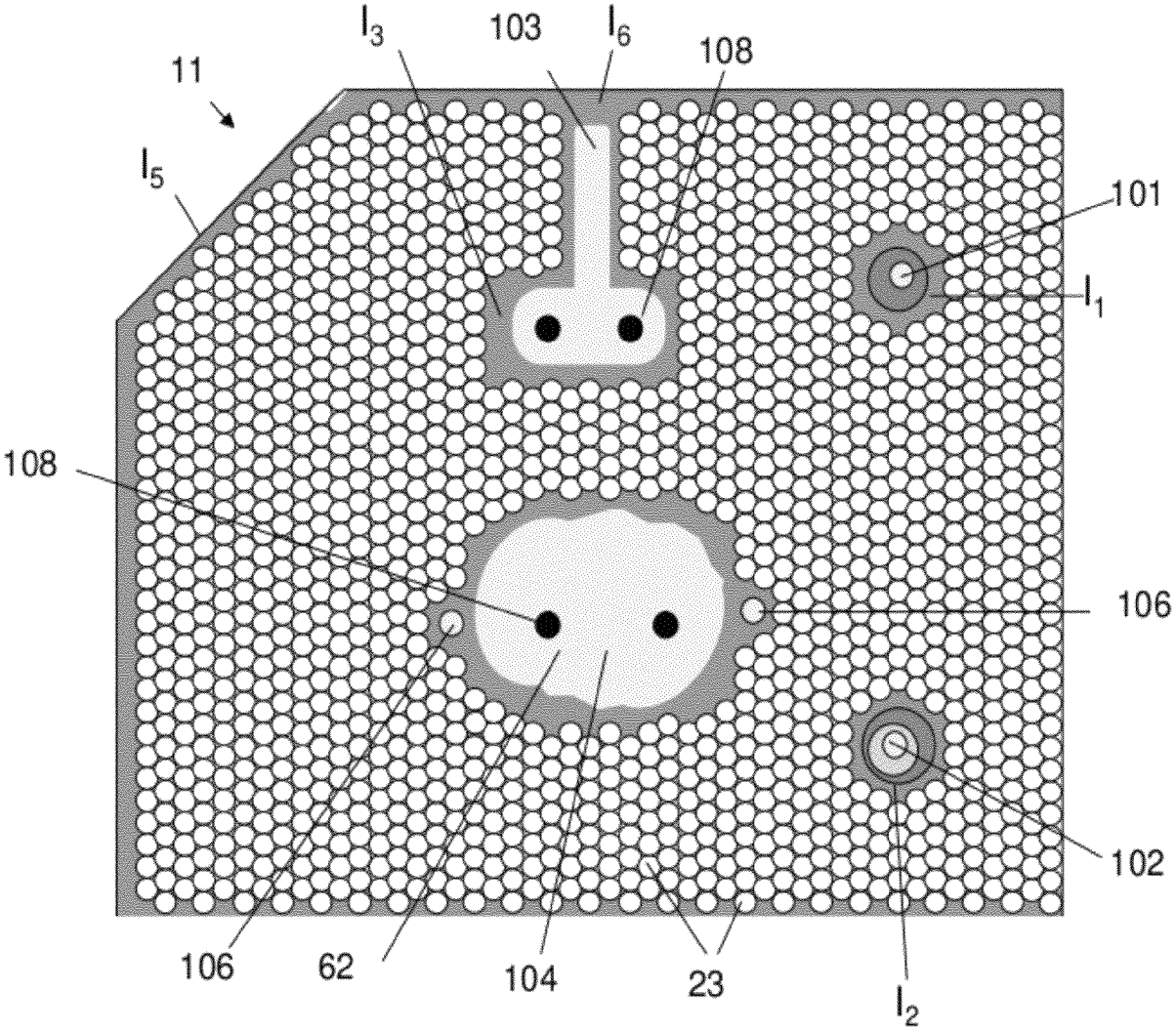
FIG. 8 is a front view of the main armor layer of the plate, shown in FIG. 2B as appears during the manufacturing process of the plate.

To cover the bores 37, 47, 65 and 65' and the apertures 57 and 67 during the manufacture of the armor plate 10 in order to prevent binder material from entering there, temporary covers 101, 102, 106, 103 and 104, respectively, are used, as shown in FIG. 8, that are mounted before the application of the binder material to the pellets 23 and the front and back layers 13 and 12 and the application of heat and pressure to the entire structure. The covers 103 and 104 may be fitted with positioning elements 108 for facilitating their positioning within the corresponding inserts $I_3$ and $I_4$.

When the inserts are not required to be made of a ballistic material, as detailed above, they may be made by molding in situ, i.e. by filling the gaps within the main layer 11 with a solidifying material, such as, for example, epoxy-based two-component materials, during the manufacturing process. For example, edge inserts $I_5$ and $I_6$ may be made by such a process.

After the manufacturing process described above is completed, covers 101, 102, 106, 106', 103 and 104 are removed.

As the covers 101, 102, 108, 103 and 104 do not constitute a part of the plate 10 when fixed to the structure 10, they may be made from any heat- and pressure-resistant material suitable for the manufacturing process described in the above reference.

The plate 10 described above is commonly, mounted to the exterior wall of the vehicle. In the latter case, the wall of the vehicle serves to augment the energy absorbing capability of the back layer, thereby lowering the necessary thickness of the armor.

Those skilled in the art to which this invention pertains will readily appreciate that numerous changes, variations, and modifications can be made without departing from the scope of the invention, mutatis mutandis

The invention claimed is:

1. A method of manufacturing of an armor plate for use in the ballistic protection of a structure against projectiles incoming from an expected threat direction, said plate having a front face facing said threat direction, a back face and side walls therebetween, the method comprising:

(a) providing a plurality of pellets to constitute a layer of pellets, each having a circumferential surface transverse to said front face and leaving in said layer a gap occupying an area corresponding to a group of adjacent pellets, the gap having a contour at least partially defined by the circumferential surfaces of the pellets surrounding said gap;

(b) providing an insert having an outer shape mimicking the contour of said gap;

(c) applying a binder material to the pellets and the insert;

(d) heating the binder material to simultaneously form a matrix, which constitutes with the pellets and the insert a main armor layer; and (e) providing a front layer and/or a back layer, having a cutout corresponding to said insert.

2. A method according to claim 1, comprising the following additional steps of:

a first additional step of arranging the front layer in the form of a cavity, having a generally horizontal bottom and generally vertical side walls, corresponding in shape and dimensions to the front face and side walls of the plate, performed before said step (b);

a second additional step of arranging the pellets and the insert in the cavity so that the insert overlies the corresponding cutout in said front layer, performed after said first additional step and before said step (b);

a third additional step of introducing the binder material in the cavity, performed after said second additional step and before said step (c); and a fourth additional step of applying the back layer to the back of the arranged pellets and insert so that the cutout in the back layer overlies the insert, performed after said third additional step and before said step (d).

3. A method according to claim 2, wherein said insert comprises an insert frame having said outer shape and having an inner shape different from said outer shape.

4. A method according to claim 3, further comprising a fifth additional step of mounting within said insert frame at least one core occupying the interior of said frame, performed between said steps (a) and (b).

5. A method according to claim 4, wherein said one core is formed with a fixation bore adapted to let a fixation screw pass therethrough.

6. A method according to claim 5, wherein said core and said fixation bore each has a central axis and the central axis of the fixation bore is radially spaced from an axis of the central axis of said core.

7. A method according to claim 6, further comprising rotating said at least one core about its axis to take different positions relative to the frame and allowing thereby the fixation bore to take corresponding different positions relative to said plate to bring the fixation bore in alignment with a corresponding bore in the structure to be protected.

8. A method according to claim 7, further comprising:

a sixth additional step of covering said insert with a cover before performing said second additional step, to prevent the binder material from entering those portions of the insert that are covered by the cover, and a seventh additional step of removing the cover after said sixth additional step.

9. A method according to claim 8, wherein said cover is adapted to cover said fixation bore.

10. A method according to claim 1, wherein the insert is at least partially made of a material different from that of the pellets.

11. A method according to claim 10, wherein the material from which the insert is at least partially made is a non-ballistic material.

12. A method according to claim 10, wherein the material from which the insert is at least partially made has hardness lower than that of the material of the pellets.

13. A method according to claim 10, wherein the material from which the insert is at least partially made is a ballistic material.

14. A method according to claim 10, wherein said material from which the insert is at least partially made is a solidifying material capable of being disposed in said gap in a non-solidified state and of being brought into its solidified state within the gap to form at least a part of said insert.

* * * * *